US010846995B2

(12) United States Patent
Kida

(10) Patent No.: US 10,846,995 B2
(45) Date of Patent: Nov. 24, 2020

(54) PROCESSING TERMINAL AND PROCESSING METHOD

(71) Applicant: TOSHIBA TEC KABUSHIKI KAISHA, Tokyo (JP)

(72) Inventor: Tomoaki Kida, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/252,161

(22) Filed: Jan. 18, 2019

(65) Prior Publication Data

US 2019/0228615 A1 Jul. 25, 2019

(30) Foreign Application Priority Data

Jan. 22, 2018 (JP) ..... 2018-008243

(51) Int. Cl.
*G07G 1/00* (2006.01)
*G07G 1/12* (2006.01)

(52) U.S. Cl.
CPC ..... *G07G 1/0018* (2013.01); *G07G 1/0009* (2013.01); *G07G 1/12* (2013.01)

(58) Field of Classification Search
CPC ..... G07G 1/0018; G07G 1/0009; G07G 1/12
See application file for complete search history.

(56) References Cited

U.S. PATENT DOCUMENTS 6,003,008 A 12/1999 Postrel et al.
6,394,344 B1 * 5/2002 Katsumura ..... G06K 17/0022 235/380
6,573,886 B1 6/2003 Lehtinen et al.
9,778,767 B2 10/2017 Nakata et al.
2013/0076591 A1 3/2013 Sirpal et al.
(Continued)

FOREIGN PATENT DOCUMENTS

CN 102298419 A 12/2011
EP 1076281 A2 2/2001

OTHER PUBLICATIONS

Extended European Search Report dated Jun. 28, 2019, filed in counterpart European Patent Application No. 19152861.1, 11 pages.
(Continued)

*Primary Examiner* — Seung H Lee
(74) *Attorney, Agent, or Firm* — Kim & Stewart LLP

(57) ABSTRACT

A processing terminal includes a first housing having an opening, a second housing, an operation panel disposed on the second housing. The second housing is rotatably attached to the first housing between a closed position in which the second housing closes the opening of the first housing and a non-closed position in which a gap is formed between the opening of the first housing and the second housing. The processing terminal further includes a sensor and a controller. The sensor is configured to detect at least one of the second housing in the closed position and the second housing in the non-closed position. The controller is configured to determine whether or not the second housing is in the non-closed position based on a detection result of the sensor and disable the operation panel upon determining that the second housing is in the non-closed position.

14 Claims, 12 Drawing Sheets

(56) References Cited

U.S. PATENT DOCUMENTS

| | | | | |
|---|---|---|---|---|
| 2013/0235420 | A1* | 9/2013 | Nihashi | G07G 1/0018 358/1.15 |
| 2014/0145938 | A1 | 5/2014 | Tian | |
| 2016/0062415 | A1 | 3/2016 | Cudak et al. | |
| 2016/0358149 | A1* | 12/2016 | Suzuki | G06Q 20/206 |
| 2017/0372286 | A1* | 12/2017 | Hiroi | G06Q 20/20 |

OTHER PUBLICATIONS

Chinese First Office Action dated Jun. 29, 2020, mailed in counterpart Chinese Patent Application No. 201910041493.6, 16 pages (with Translation).

* cited by examiner

PROCESSING TERMINAL AND PROCESSING METHOD

CROSS-REFERENCE TO RELATED APPLICATION

This application is based upon and claims the benefit of priority from Japanese Patent Application No. 2018-008243, filed on Jan. 22, 2018, the entire contents of which are incorporated herein by reference.

FIELD

Embodiments described herein relate generally to a processing terminal and a processing method.

BACKGROUND

In the related art, there is a processing terminal having a first housing, a second housing with a display and a touch panel disposed on an upper surface thereof and rotatably attached to the first housing. In such a processing terminal, an unintended operation may be executed by unintentional touching of the touch panel when a user grips the second housing in order to rotate the second housing with respect to the first housing.

DETAILED DESCRIPTION

An embodiment is directed to providing a processing terminal and a processing method capable of preventing execution of unintended operations.

In general, according to an embodiment, a processing terminal includes a first housing having an opening, a second housing, an operation panel disposed on the second housing. The second housing is rotatably attached to the first housing between a closed position in which the second housing closes the opening of the first housing and a non-closed position in which a gap is formed between the opening of the first housing and the second housing. The processing terminal further includes a sensor and a controller. The sensor is configured to detect at least one of the second housing in the closed position and the second housing in the non-closed position. The controller is configured to determine whether or not the second housing is in the non-closed position based on a detection result of the sensor and disable the operation panel upon determining that the second housing is in the non-closed position.

A processing terminal 1 according to an embodiment will be described with reference to FIGS. 1 to 12.

Figure 1:
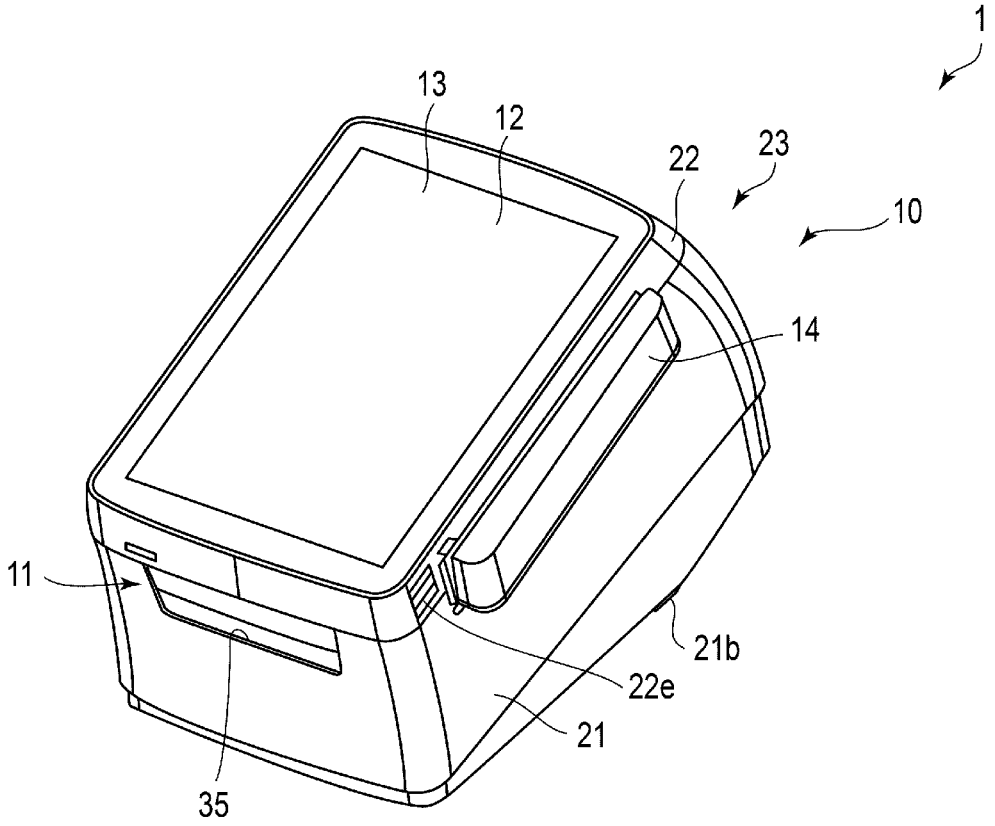
FIG. 1 illustrates a configuration of a processing terminal according to an embodiment, in particular, a perspective view of the processing terminal in a closed state in which a second housing is covering a first housing.
Figure 2:
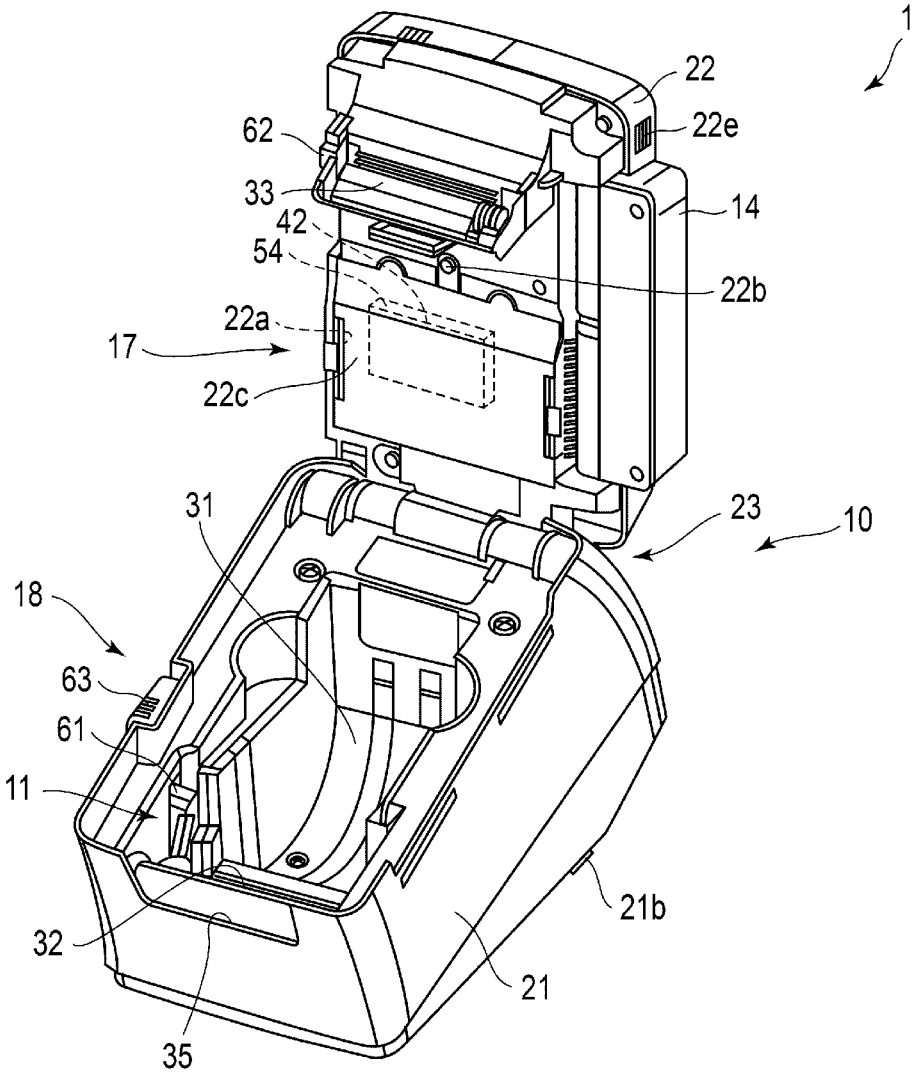
FIG. 2 illustrates a configuration of the processing terminal, in particular, a perspective view of the processing terminal in an open state in which the second housing is standing with respect to the first housing.
Figure 3:
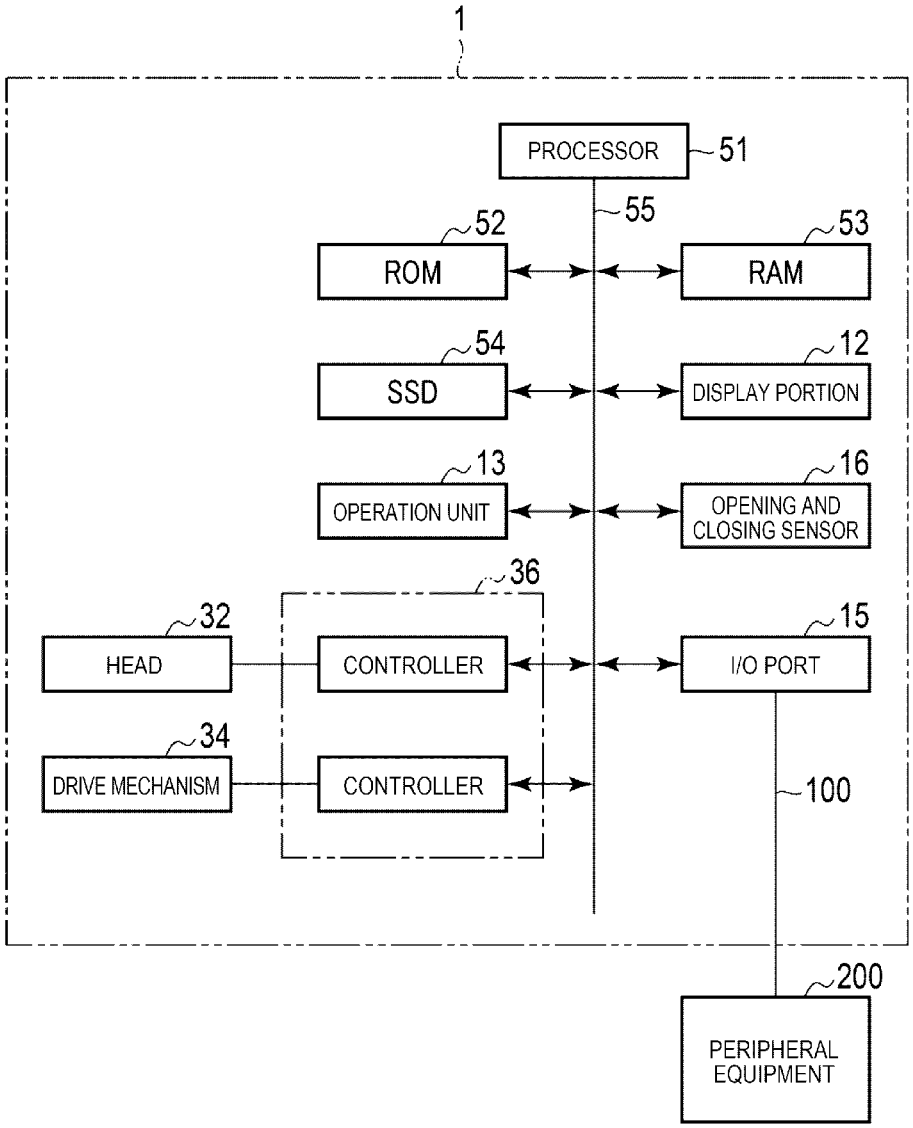
FIG. 3 is a block diagram showing a configuration of the processing terminal.
Figure 4:
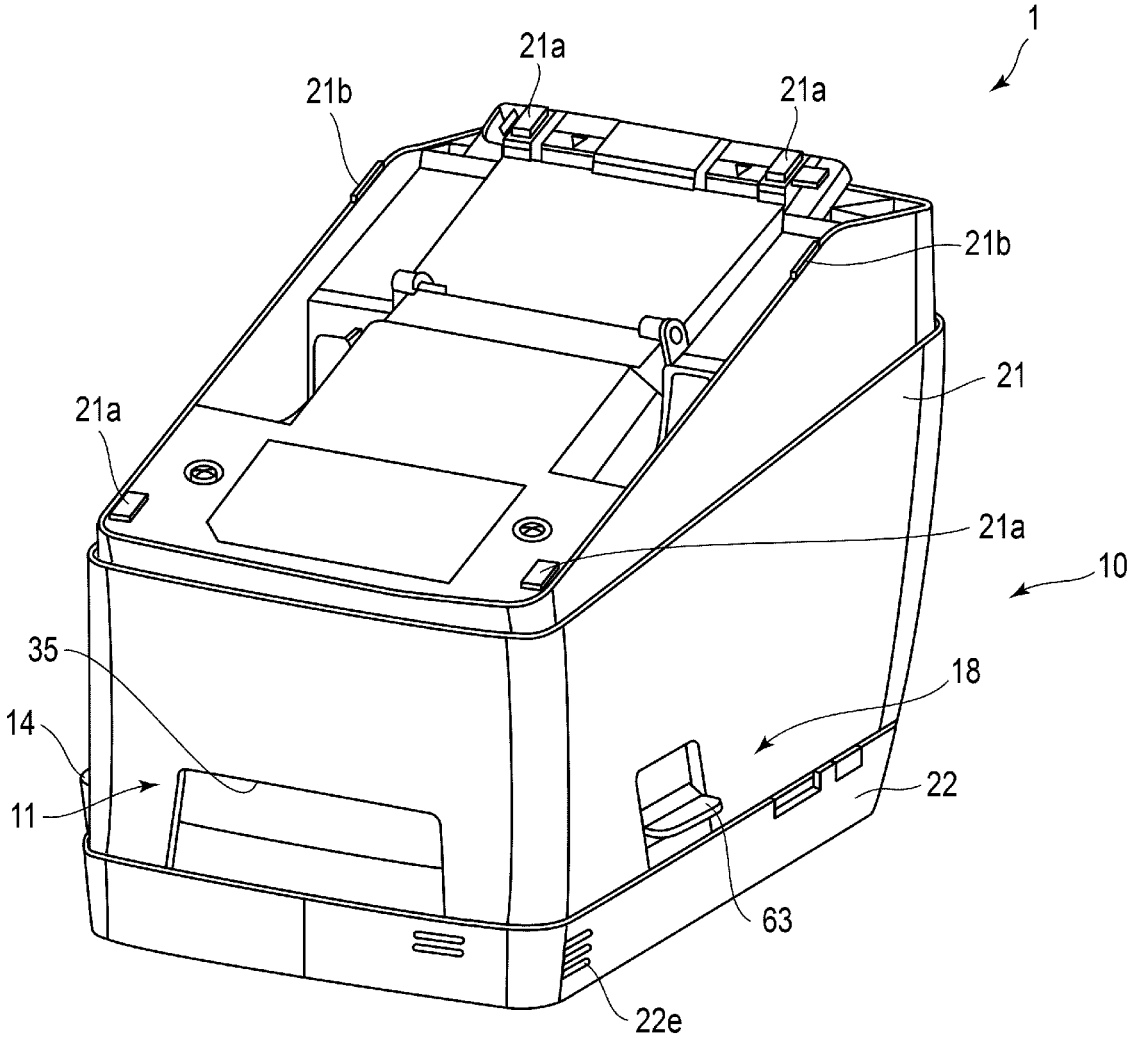
FIG. 4 illustrates a perspective view of a bottom surface of the processing terminal.

The processing terminal 1 is shown in FIGS. 1 to 3. FIG. 1 illustrates a configuration of the processing terminal 1, in particular, a perspective view of the processing terminal 1 in a closed state in which a second housing is covering a first housing. FIG. 2 illustrates a configuration of the processing terminal 1, in particular, a perspective view of the processing terminal 1 in an open state in which the second housing is standing with respect to the first housing. FIG. 3 is a block diagram showing a configuration of the processing terminal 1. Hereinafter, a hinge portion 23 side of the processing terminal 1 will be described as a rear side, and a side opposite to the hinge portion 23 side of the processing terminal 1 will be described as a front side.

The processing terminal 1 includes a housing 10, a printer 11, a display 12, an operation unit 13, a card reader writer 14, an input/output (I/O) port 15, an opening and closing sensor 16, an engine unit 17, and an opening and closing mechanism 18. The processing terminal 1 is, for example, a point-of-sale (POS) terminal installed in a store and performs settlement processing such as input and communication of purchase information, receipt issuance, and reading information on a credit card and the like.

As shown in FIGS. 1 and 2, the housing 10 includes a first housing 21, a second housing 22 that rotates with respect to the first housing 21, and the hinge portion 23 that rotatably connects the first housing 21 and the second housing 22. The housing 10 is configured in a substantially rectangular box shape in which an upper surface thereof is inclined downward from the hinge portion 23 side toward the front side opposite to the hinge portion 23 side by covering the first housing 21 with the second housing 22.

As shown in FIGS. 1 and 2, the first housing 21 is configured in a rectangular box shape and the upper surface thereof is inclined from the hinge portion 23 side toward the front side. As shown in FIGS. 4 to 6 and 8, the first housing 21 has, for example, a plurality of legs 21*a* and a plurality of auxiliary legs 21*b* that abut against an installation region on the bottom surface. In the present embodiment, the first housing 21 has four legs 21*a* and two auxiliary legs 21*b*. The legs 21*a* are formed of a resin material having a large friction coefficient such as a rubber, and prevents the first housing 21 from slipping by abutting against the installation region. Two of the legs 21*a* are disposed on the front side of the first housing 21 and two of the legs 21*a* are disposed on the rear side of the first housing 21. The auxiliary legs 21*b* are a projection integrally provided on the first housing 21, and are disposed between the legs 21*a* on the front side and the legs 21*a* on the rear side of the first housing 21 on the bottom surface of the first housing 21. The first housing 21 houses or holds a portion of the printer 11, the I/O port 15, the opening and closing sensor 16, and the like.

As shown in FIGS. 1, 3, 6, and 9, the second housing 22 houses or holds a portion of the printer 11, the display 12, the operation unit 13, the card reader writer 14, and the engine unit 17. The second housing 22 is configured in a rectangular plate shape, and has a space capable of housing the engine unit 17 therein. The second housing 22 is a cover that covers an upper surface of the first housing 21.

Figure 9:
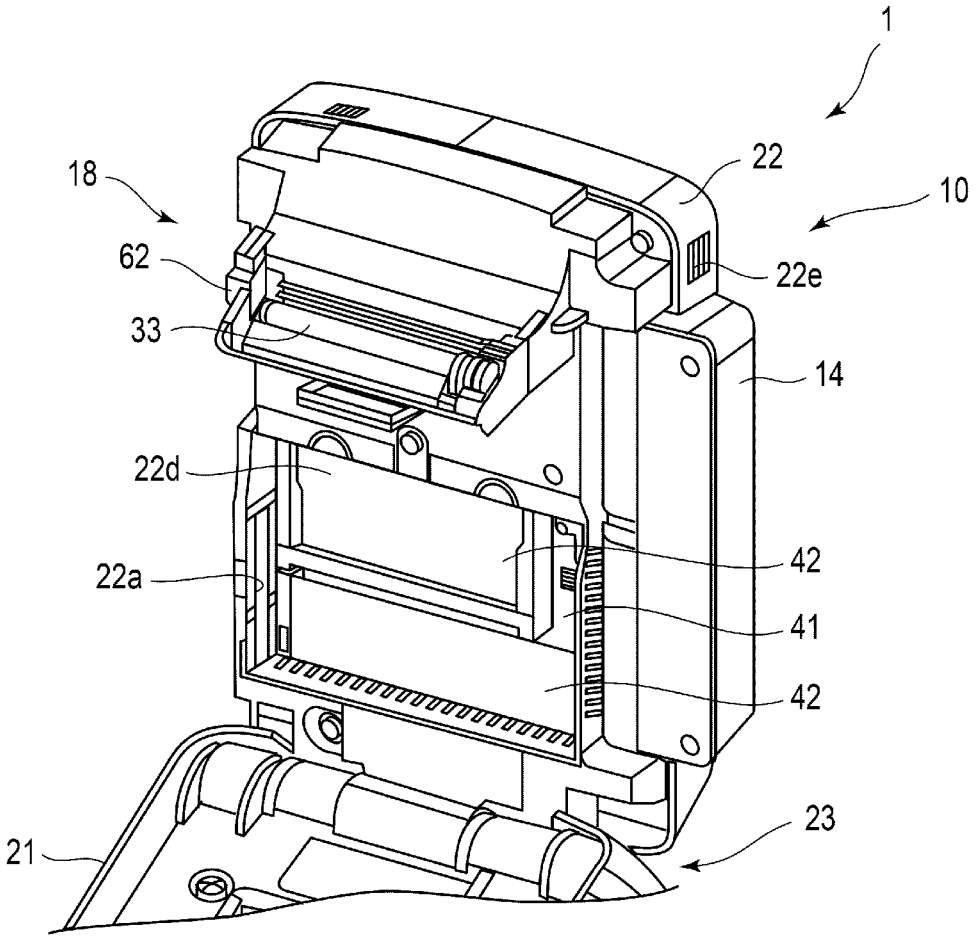
FIG. 9 illustrates a perspective view of the second housing of the processing terminal.

As a specific example, the second housing 22 has the display 12 and the operation unit 13 on the upper surface of the second housing 22, thereby constituting an operatable display unit. As shown in FIG. 2, the second housing 22 includes an opening 22*a* and a cover 22*c* detachable from the opening 22*a* by a screw 22*b* on a surface that faces the first housing 21. As shown in FIG. 9, the second housing 22 includes a mounting portion 22*d* therein. As shown in FIGS. 1, 2, 4 to 6, and 9 to 11, the second housing 22 includes an inlet 22*e* provided at end portions of both side surfaces on the front side and an outlet 22*f* provided on the rear side, which is the hinge portion 23 side. The second housing 22 may include a pipe and the like forming a portion of an air flow path from the inlet 22*e* to the outlet 22*f*, depending on configuration of the engine unit 17 housed therein and other configurations.

As shown in FIGS. 2 and 9, the opening 22*a* is configured in a size such that an exchangeable exchange member 54 provided in the engine unit 17 can pass through the opening 22*a*. The opening 22*a* is disposed on the hinge portion 23 side of an outer surface portion of the second housing 22 on the first housing 21 side. Here, the outer surface portion of the second housing 22 on the first housing 21 side is a portion of the second housing 22 that faces the first housing 21 when the second housing 22 and the first housing 21 face each other in a state in which the second housing 22 covers the first housing 21. Here, the state in which the second housing 22 covers the first housing 21 means the state in which the second housing 22 abuts against the first housing 21, and the processing terminal 1 is closed by fixing the second housing 22 to the first housing 21 by the opening and closing mechanism 18 described below. A state in which the first housing 21 and the second housing 22 are fixed by the opening and closing mechanism 18 is a closed state. A state in which the first housing 21 and the second housing 22 are not fixed by the opening and closing mechanism 18 is an open state. A screw hole to screw the screw 22*b* is provided around the opening 22*a*.

As shown in FIG. 2, the cover 22*c* covers the opening 22*a*. The cover 22*c* may have a hole for ventilation. The cover 22*c* is attached to the opening 22*a* by the screw 22*b*.

As shown in FIG. 9, the mounting portion 22*d* is disposed at a position facing the opening 22*a* inside the second housing 22. The exchangeable exchange member 54 provided in the engine unit 17 is configured to be detachable from the mounting portion 22*d*. As a specific example, the mounting portion 22*d* has an attachment to which the exchange member 54 is connected and a screw hole with which the screw inserted into the exchange member 54 is screwed together.

Figure 6:
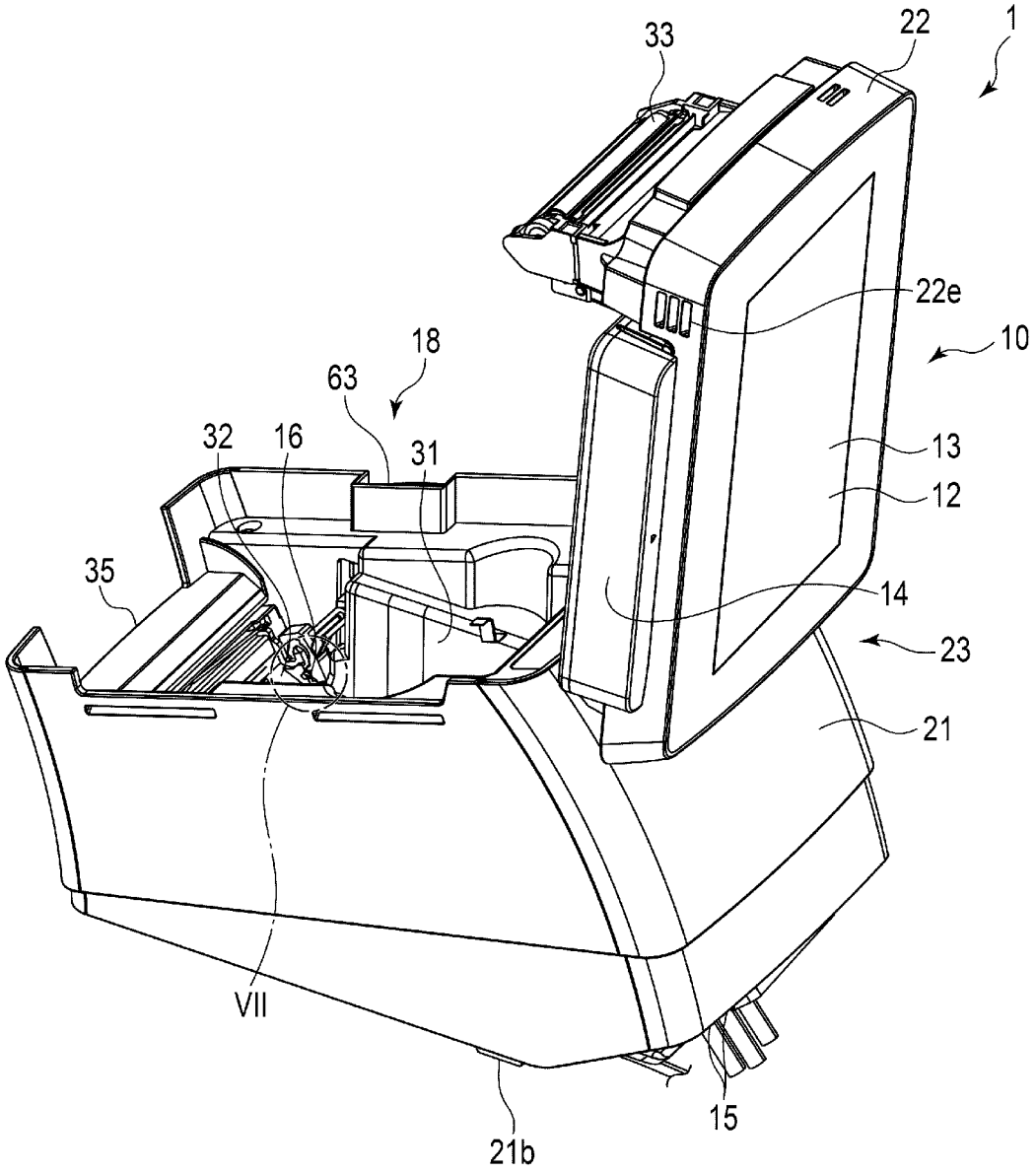
FIG. 6 illustrates a perspective view of the processing terminal including an opening and closing sensor provided in the processing terminal.

As shown in FIG. 6, the inlet 22*e* is an opening for sucking the air, and a plurality of the inlets 22*e* are provided in an opening shape that can prevent intrusion of foreign matters or the like. The number and shape of the inlets 22*e* can be set appropriately. The inlet 22*e* is provided at end portions of both side surfaces of the second housing 22 on the front side so that the second housing 22 is disposed below the outlet 22*f* when covering the first housing 21.

Figure 10:
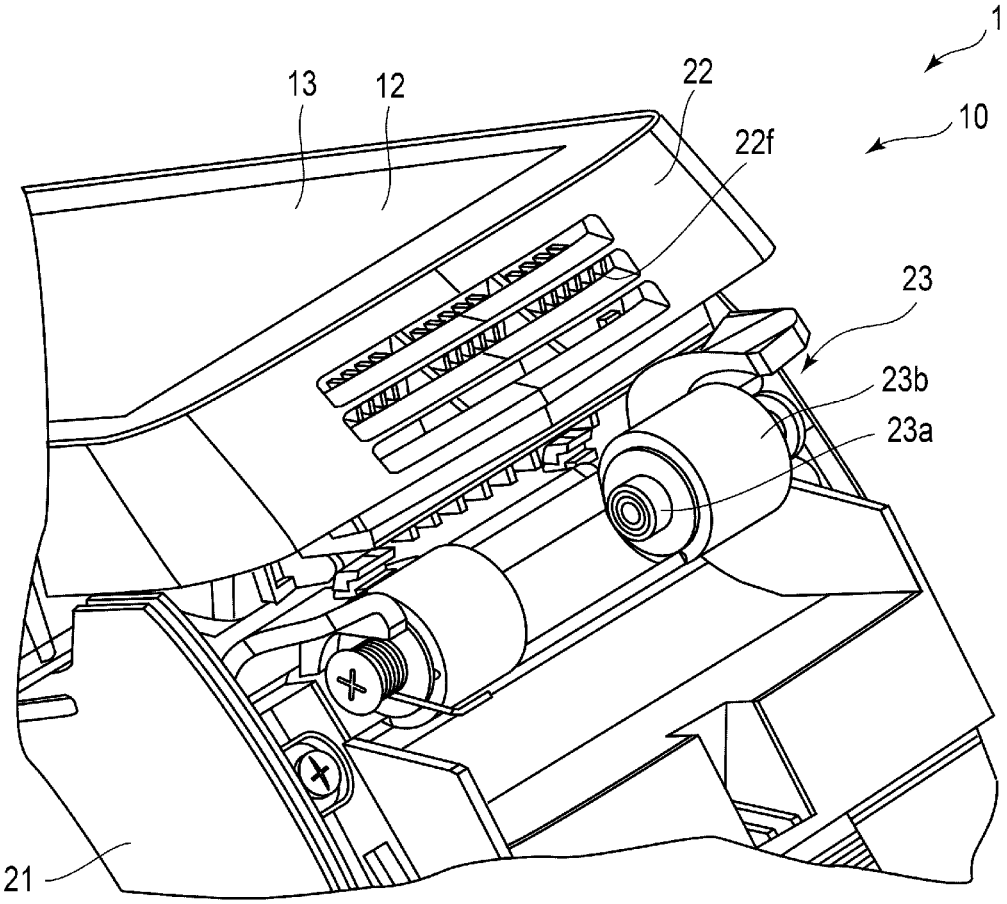
FIG. 10 illustrates a perspective view of a hinge portion of the processing terminal.

As shown in FIG. 10, a plurality of the outlets 22*f* are provided in an opening shape that can prevent intrusion of foreign matters or the like. For example, the total opening area of the outlets 22*f* is set to be equal to or larger than the total opening area of the inlets 22*e*.

Figure 11:
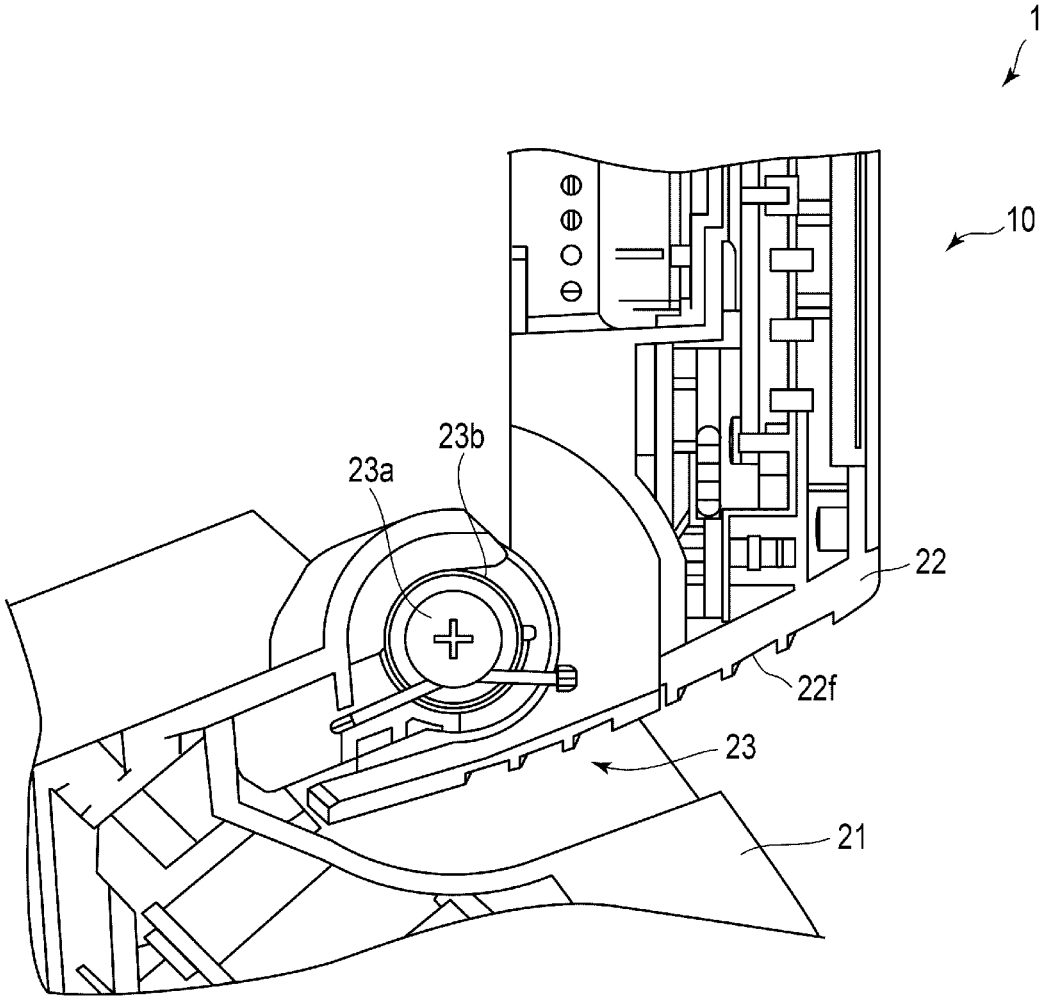
FIG. 11 illustrates a side view of the hinge portion.

As shown in FIGS. 10 and 11, the hinge portion 23 is a rotation shaft that enables rotation of the second housing 22 with respect to the first housing 21. The hinge portion 23 has, for example, a rotation shaft 23*a*, the rotation shaft 23*a* is fixed to one of the first housing 21 and the second housing 22, and a shaft support portion 23*b* which rotatably holds the rotation shaft 23*a* is provided on the other of the first housing 21 and the second housing 22. The hinge portion 23 restricts the rotation of the second housing 22 such that the second housing 22 rotates with respect to the first housing 21 between an open position in which the second housing 22 stands so as to substantially extend in a gravity direction and a closed position in which the second housing 22 covers the first housing 21, in a state in which the first housing 21 is placed at the installation region.

As shown in FIGS. 2 and 3, the printer 11 includes a paper storage unit 31, a head 32, a platen 33, a drive mechanism 34, a paper discharge port 35, and a control board 36. The printer 11 supplies roll paper to the head 32 by the platen 33, and performs printing on the roll paper by the head 32. For example, the roll paper is formed by winding strip-shaped thermal paper long in one direction which generates color with heat.

Figure 8:
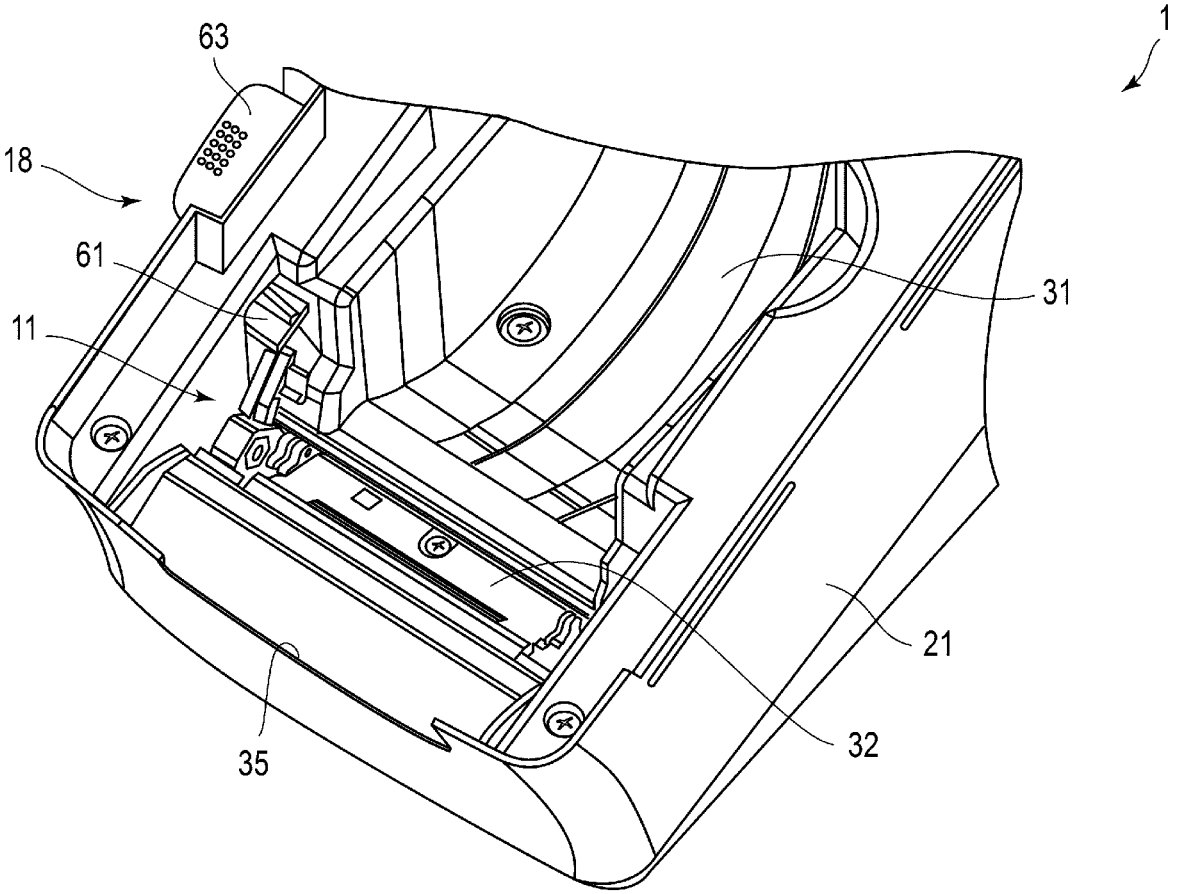
FIG. 8 illustrates a perspective view of part of the first housing of the processing terminal.

As shown in FIGS. 2 and 8, the paper storage unit 31 is provided on an upper portion of the first housing 21. The paper storage unit 31 is configured such that the upper portion of the first housing 21 is recessed in a semi-cylindrical shape so that the center of the roll paper can be housed in a direction orthogonal to a longitudinal direction and orthogonal to the gravity direction of the housing 10. As a result, a feeding direction of the roll paper is in a direction from the rear side which is the hinge portion 23 side of the housing 10 to the front side which is a side facing the hinge portion 23.

The head 32 is a thermal head. As shown in FIG. 8, the head 32 is capable of partially generating heat in the feeding direction of the roll paper when feeding, that is, a width direction orthogonal to the direction from the rear side toward the front side of the housing 10. The head 32 is disposed at the upper portion of the first housing 21 and on the front side with respect to the paper storage unit 31.

The platen 33 is a so-called platen roller. As shown in FIG. 2, the platen 33 is provided at a position of the second housing 22 facing the head 32 provided in the first housing 21. The platen 33 pinches the thermal paper between the head 32 and the platen 33 and is rotationally driven by the drive mechanism 34 to transport the thermal paper along the feeding direction.

The drive mechanism 34 is configured of, for example, a motor, a gear, or the like, and rotates around the platen 33.

As shown in FIG. 1, the paper discharge port 35 is provided at a portion facing the first housing 21 and the second housing 22 on a front surface of the housing 10, and is an opening for discharging the roll paper. The paper discharge port 35 includes, for example, a cutter and the like for cutting the roll paper provided in the first housing 21.

As shown in FIG. 3, the control board 36 is electrically connected to the head 32 and the drive mechanism 34, and has a controller that controls the operations of the head 32 and the drive mechanism 34. The control board 36 is electrically connected to the engine unit 17, and controls the heat generation of the head 32 and the driving of the drive mechanism 34. The control board 36 is disposed in the first housing 21.

The display 12 includes, for example, a liquid crystal display and glass for protecting the surface of the liquid crystal display. As shown in FIGS. 1 and 6, the display 12 is disposed substantially over the entire outer surface of the second housing 22 constituting an upper surface of the housing 10. The display 12 is configured to display information. An on state of the display 12 is a state in which information is displayed on the display 12. An off state of the display 12 is the state in which information is not displayed on the display 12.

The operation unit 13 is an input unit for inputting a key signal for operating the processing terminal 1. The operation unit 13 is, for example, a touch panel. As shown in FIGS. 1 and 6, the operation unit 13 is disposed between, for example, the liquid crystal display and the glass of the display 12 or is provided integrally with the glass. The operation unit 13 is disposed in the same range with the display 12 or is disposed in a wider range than the display 12. The operation unit 13 recognizes the touch operation, and transmits a signal corresponding to the touch operation to the engine unit 17. The operation unit 13 may have a hard key such as a button in addition to the touch panel. An on state of the operation unit 13 is a state in which the function of the operation unit 13 is enabled so that the input signal is transmitted to the engine unit 17. An off state of the operation unit 13 is a state in which the engine unit 17 is inactive so that the input signal is not generated by the operation unit 13 or the transmission of the input signal is disabled.

As shown in FIG. 1, the card reader writer 14 is provided on one side surface of the second housing 22. The card reader writer 14 is capable of reading information recorded on a card and writing information on the card. Here, the card is, for example, a payment card such as a credit card or a prepaid card.

Figure 5:
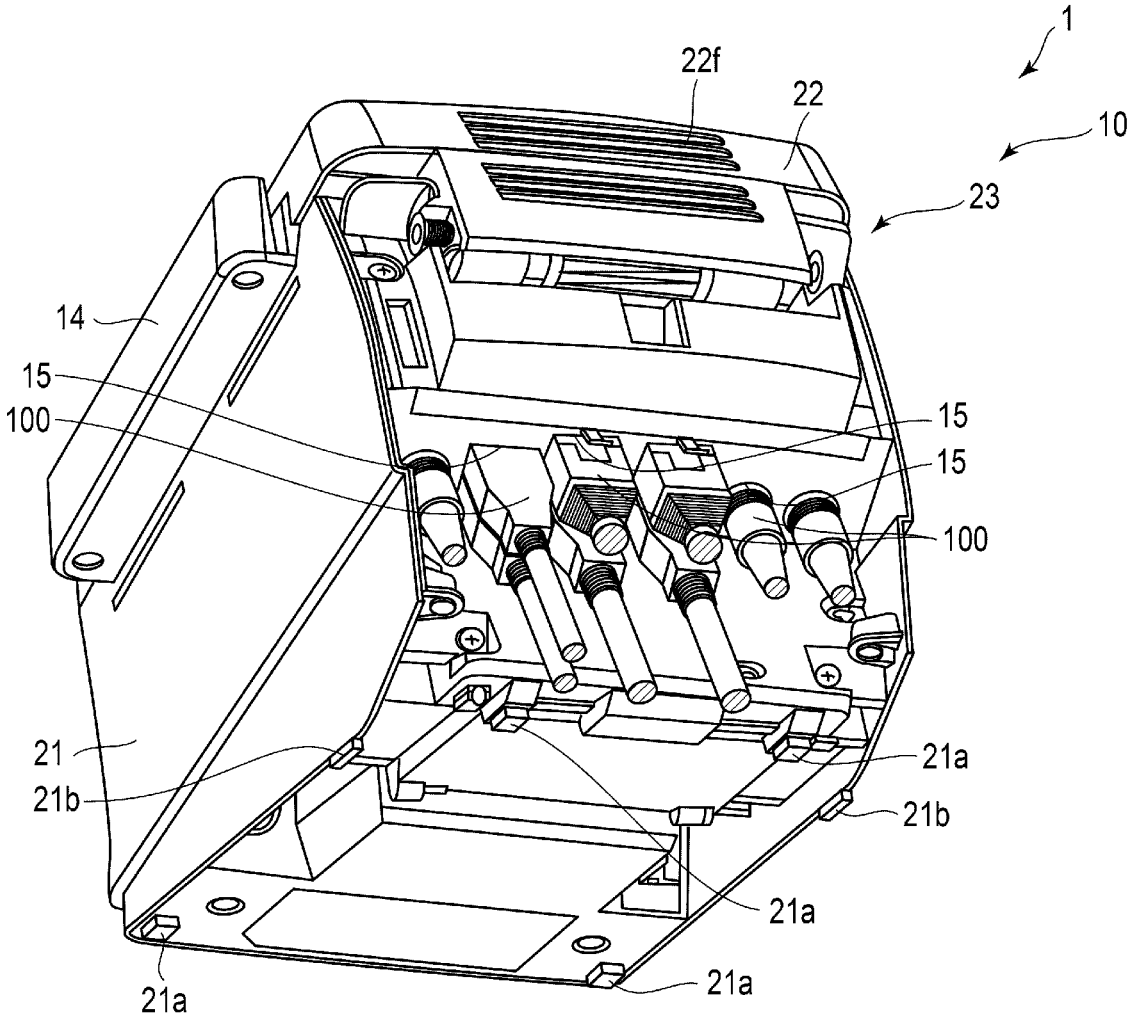
FIG. 5 illustrates a perspective view of a rear surface of the processing terminal.

As shown in FIG. 5, the I/O port 15 is, for example, a connector such as a USB port provided on an I/O board. The I/O port 15 is connected to a cable terminal 100 connected to a peripheral equipment 200 and the like.

Figure 7:
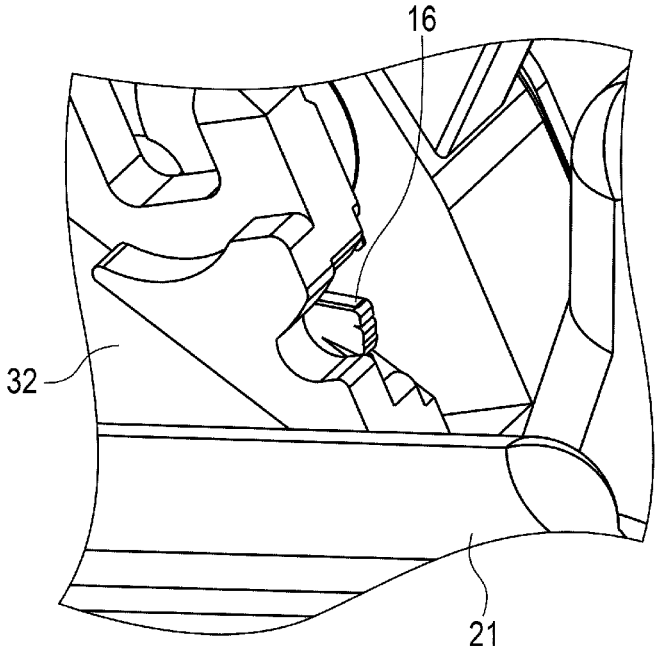
FIG. 7 illustrates a partial enlarged view of the opening and closing sensor in the region VII in FIG. 6.

As shown in FIGS. 6 and 7, the opening and closing sensor 16 is disposed in a vicinity of the head 32 of the first housing 21. The opening and closing sensor 16 is operated by a member that operates the opening and closing sensor 16 provided around the platen 33 or the platen 33 when the platen 33 comes into contact with the head 32. The opening and closing sensor 16 transmits the operated information as a signal to the engine unit 17.

The opening and closing sensor 16 is, for example, a sensor which detects a closed state of the second housing 22 with respect to the first housing 21. The opening and closing sensor 16 is in the on state when the second housing 22 is in a closed state with respect to the first housing 21, and transmits signals to the engine unit 17. The opening and closing sensor 16 is in the off state when the second housing 22 is in an open state with respect to the first housing 21, and does not transmit signals to the engine unit 17.

As shown in FIG. 9, the engine unit 17 includes a board 41 and a circuit element 42 mounted on the board. The board 41 is housed in the second housing 22. At least a portion of the board 41 constitutes the mounting portion 22*d*, and at least a portion constituting the mounting portion 22*d* on the board 41 is disposed at a position facing the opening 22*a*. The circuit element 42 includes, for example, a processor 51, a ROM 52, a RAM 53, and an SSD 54. A portion of the circuit element 42 is configured, for example, to be detachable from the board 41. The engine unit 17 is stored in the second housing 22, and the portion of the circuit element 42 detachable from the board 41 is disposed at a position facing the opening 22*a*.

As shown in FIG. 3, the processor 51 is connected to the ROM 52, the RAM 53, the SSD 54, the display 12, the operation unit 13, the I/O port 15, the opening and closing sensor 16, and a controller including the control board 36 via a system transmission line 55. The system transmission line 55 includes an address bus, a data bus, a control signal line, and the like. The processor 51 is a control unit that controls each portion to perform various functions as the processing terminal 1 based on an operating system, a middleware, and an application program stored in the ROM 52 and the RAM 53.

As shown in FIGS. 2, 8, and 9, the opening and closing mechanism 18 includes an engaging portion 61 which is provided in the first housing 21, an engaged portion 62 which is provided in the second housing 22, and an operation body 63 which is provided on an outer surface of the first housing 21 and operates the engaging portion 61. The opening and closing mechanism 18 is configured such that the engaging portion 61 and the engaged portion 62 can be engaged to each other by the second housing 22 covering the first housing 21. The operation body 63 releases the engagement of the engaging portion 61 and the engaged portion 62 by being operated. The operation body 63 is, for example, a button mechanically connected to the engaging portion 61 and transitions from a state where the engaging portion 61 is engaged with the engaged portion 62 to a state where the engagement is released when the button is pressed.

Figure 12:
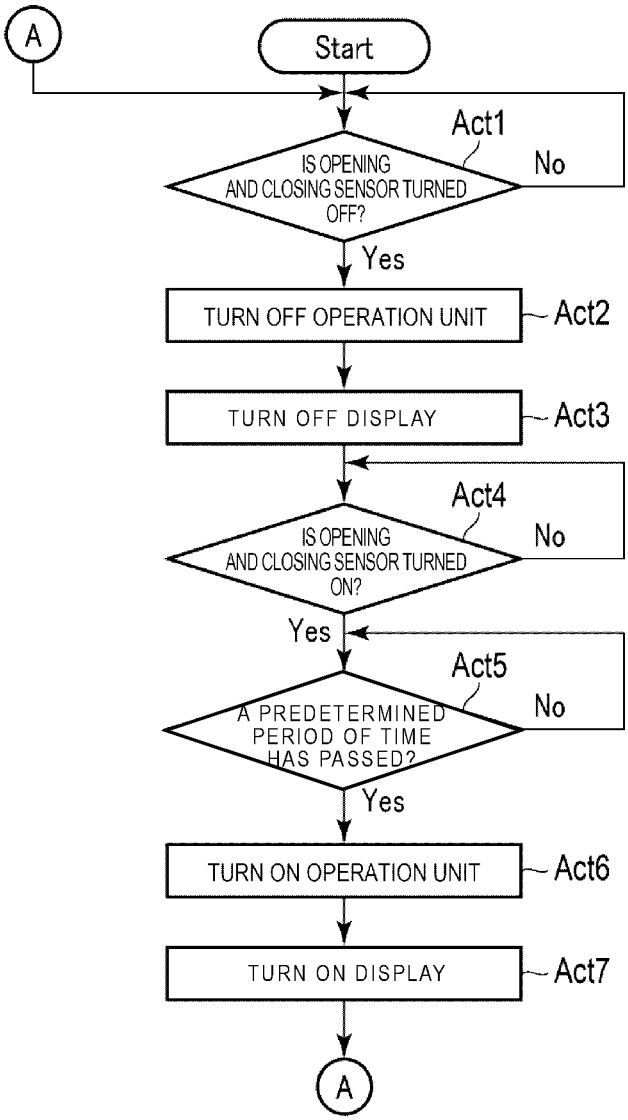
FIG. 12 is a flowchart showing an example of processing executed by the processing terminal.

Hereinafter, an example of processing executed by the processing terminal 1 with the opening and closing of the second housing 22 with respect to the first housing 21 will be described with reference to FIG. 12. In the present embodiment, a flow includes transition from a state where the processing terminal 1 is in the closed state and the display 12 and the operation unit 13 are in the on state to a state where the processing terminal 1 is in the open state, and then to the closed state again.

First, when the processing terminal 1 is in a closed state, and the display 12 and the operation unit 13 are in the on state, the processor 51 determines whether or not the opening and closing sensor 16 is turned off by the second housing 22 being separated from the first housing 21 (Act 1). Here, the second housing 22 is separated from the first housing 21 by, for example, an operator operating the operation body 63 of the opening and closing mechanism 18 and releasing the engagement with the first housing 21. When the processor 51 determines that the opening and closing sensor 16 is turned off (Yes in Act 1), the processor 51 turns off the operation unit 13 (Act 2). The processor 51 turns off the display 12 (Act 3). When the opening and closing sensor 16 is on (No in Act 1), the process returns to Act 1.

Next, after the display 12 is turned off (Act 3), the processor 51 determines whether or not the opening and closing sensor is turned on by the first housing 21 being covered with the second housing 22 again (Act 4). When the opening and closing sensor 16 is turned on (Yes in Act 4), the processor 51 proceeds to Act 5. When the opening and closing sensor is off, the process returns to Act 4.

When the opening and closing sensor is turned on (Yes in Act 4), the processor 51 next determines whether or not a predetermined time period has passed (Act 5). A value of the predetermined time period is stored in the RAM 53. The processor 51 reads and uses the value of the predetermined time period stored in the RAM 53. When the predetermined time period has passed (Yes in Act 5), the processor 51 turns on the operation unit 13 (Act 6). The processor 51 turns on the display 12 (Act 7). Then, the process proceeds to Act 1. When the predetermined time period has not passed (No in Act 5), the process returns to Act 5.

According to the processing terminal 1 of the above-described described embodiment, the display 12 and the operation unit of the processing terminal 1 are disposed over the substantially entire outer surface of the second housing 22. For that reason, when the processing terminal 1 transitions from the closed state to the open state, the display 12 and the operation unit 13 are more likely to be operated while the operator touches the display 12 and the operation unit 13 to push the second housing 22 into the first housing 21. When the processing terminal 1 transitions from the closed state to the open state, the display 12 and the operation unit 13 are more likely to be operated while the operator grips the second housing 22 and touches the display 12 and the operation unit 13 to lift the second housing 22. According to the processing terminal 1 of the embodiment, if the engine unit 17 stops the function of the operation unit 13 when the opening and closing sensor 16 detects that the second housing 22 is in the open state with respect to the first housing 21. Therefore, when an operator touches the display 12 and the operation unit 13 in order to rotate the second housing 22 with respect to the first housing 21, it is possible to prevent execution of an unintended operation of the operator accompanied by the touch in the processing terminal 1.

When the opening and closing sensor 16 detects that the second housing 22 is in the open state with respect to the first housing 21, power consumption of the processing terminal 1 can be reduced by the engine unit 17 not performing display on the display 12.

When the closed state is detected after detecting the open state, the processing terminal 1 enables the function of the operation unit 13 after a lapse of a predetermined time period. Accordingly, it is possible to prevent the functions of the operation unit 13 being enabled right after the second housing 22 is closed with respect to the first housing 21 and prevent misoperations in the processing terminal 1. Thereby, the functions of the operation unit 13 in the processing terminal 1 are enabled in a state where the operator is touching the display 12 right after closing, and the execution of the unintended operations of the operator is prevented.

According to the processing terminal 1 of the above-described present embodiment, it is possible to prevent the execution of the unintended operations of the operator accompanied with opening and closing of the second housing 22 with respect to the first housing 21.

The present embodiment is not limited to the above described examples. For example, in the above-described example, the engine unit 17 stops the functions of the operation unit 13 and the power consumption is reduced by the engine unit 17 not performing display on the display 12 when the opening and closing sensor 16 detects that the second housing 22 is in the open state with respect to the first housing 21 in the processing terminal 1 but it is not limited thereto. The processing terminal 1 may be configured such that the engine unit 17 displays the display when the engine unit 17 stops the function of the operation unit 13. For example, the engine unit 17 continuously displays the display 12, or displays on the display 12 that the second housing 22 is in the open state with respect to the first housing 21. The processing terminal 1 can notify the operator the open state by displaying on the display 12 that the second housing 22 is in the open state with respect to the first housing 21.

The opening and closing sensor 16 described above is a sensor that detects the closed state of the second housing with respect to the first housing 21, but the configuration of the opening and closing sensor 16 is not limited thereto. The opening and closing sensor 16 may be a sensor that detects the open state of the second housing 22 with respect to the first housing 21. The opening and closing sensor 16 may be turned on when the second housing is in the open state with respect to the first housing 21, and transmit a signal to the engine unit 17. The opening and closing sensor 16 may be a sensor that detects both the open state and the closed state.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A processing terminal comprising:

a first housing having an opening;

a second housing rotatably attached to the first housing and rotatable between a closed position in which the second housing closes the opening of the first housing and a non-closed position in which a gap is formed between the opening of the first housing and the second housing;

a sheet container formed in the first housing;

a thermal head disposed in the first housing and configured to form an image on a thermal sheet conveyed from the sheet container;

a head controller disposed in the first housing and configured to control heating of the thermal head;

an operation panel disposed on the second housing;

a platen formed on the second housing and positioned to contact the thermal head when the second housing is in the closed position;

a sensor configured to detect the second housing in the closed position based on contact of the thermal head with the platen; and a controller configured to determine whether or not the second housing is in the non-closed position based on a detection result of the sensor and disable a user operation of the operation panel upon determining that the second housing is in the non-closed position.

2. The processing terminal according to claim 1, further comprising a display disposed on the second housing, wherein the controller is further configured to disable the display upon determining that the second housing is in the non-closed position.

3. The processing terminal according to claim 2, wherein the operation panel is a touch panel integrally formed with the display.

4. The processing terminal according to claim 1, wherein the operation panel is disposed on an outer surface of the second housing that is opposite to an inner surface that closes the opening of the first housing when the second housing is in the closed position.

5. The processing terminal according to claim 1, wherein the controller is further configured to enable the operation panel a predetermined period of time after determining that the second housing has changed from the non-closed position to the closed position.

6. The processing terminal according to claim 1, wherein the controller is further configured to enable the operation panel a predetermined period of time after determining that the second housing has changed from the non-closed position to the closed position based on detection of contract of the thermal head with the platen by the sensor.

7. A point-of-sale (POS) terminal comprising:

a first housing having an opening, wherein a roll sheet container is formed in the first housing;

a thermal head disposed in the first housing and configured to print a receipt image on a part of a rolled thermal sheet conveyed from the roll sheet container;

a second housing rotatably attached to the first housing and rotatable between a closed position in which the second housing closes the opening of the first housing and a non-closed position in which a gap is formed between the opening of the first housing and the second housing;

a touch panel display disposed on the second housing;

a sensor disposed in the first housing and configured to detect at least one of the second housing in the closed position and the second housing in the non-closed position; and a controller configured to determine whether or not the second housing is in the non-closed position based on a detection result of the sensor and disable a touch operation on the touch panel display upon determining that the second housing is in the non-closed position.

8. The POS terminal according to claim 7, wherein the controller is further configured to enable the touch operation on the touch panel display a predetermined period of time after determining that the second housing has changed from the non-closed position to the closed position.

9. The POS terminal according to claim 7, wherein the controller is further configured to disable display of the touch panel display upon determining that the second housing is in the non-closed position.

10. The POS terminal according to claim 9, wherein the controller is further configured to enable the display of the touch panel display a predetermined period of time after determining that the second housing has changed from the non-closed position to the closed position.

11. The POS terminal according to claim 10, wherein the controller is further configured to enable the touch operation on the touch panel display the predetermined period of time after determining that the second housing has changed from the non-closed position to the closed position.

12. The POS terminal according to claim 7, wherein the touch panel display is disposed on an outer surface of the second housing that is opposite to a rear surface that closes the opening of the first housing when the second housing is in the closed position.

13. The POS terminal according to claim 12, wherein the touch panel display ranges more than a half of an area of the outer surface of the second housing.

14. The POS terminal according to claim 7, wherein a rotational axis of the second housing is formed along a shorter edge of the touch panel display.

* * * * *